US006109511A

United States Patent [19]

Schluger

[11] Patent Number: 6,109,511

[45] Date of Patent: Aug. 29, 2000

[54] TRANSMITTAL ENVELOPE WITH MITER JOINT CORNERS

[76] Inventor: Allen Schluger, 21 W. 68th St., New York, N.Y. 10023

[21] Appl. No.: 09/503,447

[22] Filed: Feb. 14, 2000

[51] Int. Cl.[7] ..... B65D 5/42

[52] U.S. Cl. ..... 229/103.2; 229/114; 229/921

[58] Field of Search ..... 229/103.2, 113, 229/114, 921; 206/424

[56] References Cited

U.S. PATENT DOCUMENTS

| | | | |
|---|---|---|---|
| 3,084,843 | 4/1963 | Urban | 229/103.2 |
| 3,768,721 | 10/1973 | Carpenter et al. | 206/424 |
| 3,884,352 | 5/1975 | Pilz, III et al. | 206/424 |
| 3,968,922 | 7/1976 | Ruud | 229/114 |
| 4,114,757 | 9/1978 | Sieffert | 206/424 |
| 4,750,609 | 6/1988 | Felis | 229/921 |
| 4,955,527 | 9/1990 | Blackman et al. | 229/114 |
| 5,094,385 | 3/1992 | Antczak et al. | 229/103.2 |
| 5,305,951 | 4/1994 | Kuhn et al. | 229/113 |
| 5,660,322 | 8/1997 | Jensen | 229/103.2 |

*Primary Examiner*—Gary E. Elkins
*Attorney, Agent, or Firm*—Myron Amer P.C.

[57] ABSTRACT

Transporting items of bulk, i.e., stacked documents or boxed merchandise, which vary in extent from time to time, in an envelope that gives a desired favorable appearance of containing an item of bulk that is greater than the bulk of the item that is actually the content of the envelope, which motivates the recipient to open the envelope. The envelope is rectangular and at least along three sides has isosceles shaped gussets characterized by progressively diminishing clearance between the sides in the direction of the apex, so that the thickness or bulk of the item in the envelope is effectively engaged by the sides of the isosceles triangles before significant shifting, particularly of stacked documents, can occur as might diminish the perceived bulk based on the external appearance of the envelope.

2 Claims, 2 Drawing Sheets

TRANSMITTAL ENVELOPE WITH MITER JOINT CORNERS

The present invention relates generally to improvements in envelopes for transmitting by mail or otherwise commercial literature or the like which typically is of varying bulk and, more particularly, to envelope improvements which address the two circumstances of significant bulk and of nominal bulk. In the former circumstance, envelope expansion accommodates the significant bulk. In the latter circumstance, there is of course, no need for envelope expansion since it is not required for nominal bulk, but in the within inventive envelope there is nevertheless presented an appearance of contents with bulk which in practice contributes a motivation for the recipient to open the envelope.

EXAMPLES OF THE PRIOR ART

The use of unfolding gussets in envelopes to increase the size thereof is well known as exemplified by U.S. Pat. No. 3,063,618 issued to E. B. Berkowitz for "Expanding Envelope" on Nov. 13, 1962 and U.S. Pat. No. 768,340 issued to W. W. Ormsbee, Jr. for "Envelope" on Aug. 23, 1904. The gussets in the aforesaid are positioned initially inwardly of the envelope and, in such position, interfere with the insertion of commercial literature into the envelope.

Gussets that initially are projected outwardly of the body of the envelope and unfold inwardly towards the body solve the problem noted in connection with the '618 and '340 patented envelopes, and are embodied in U.S. Pat. No. 4,549,688 issued to Ozmon et al. for "Expandable File Folder" on Oct. 29, 1985. But whether inwardly or outwardly folding, the gusset configurations, typically that of an isosceles triangle, have not heretofore been used to advantage to maintain a neat appearance in a transmittal envelope for contents of varying bulk.

More particularly, it is known from common experience that an envelope should have a neat appearance in order to make a good impression, and that this appearance is mainly the manner in which it maintains, or conversely, does not maintain its shape, or the parallelism of its front cover and rear panels. Maintaining a neat appearance is a more demanding requirement when the contents of the envelope varies from time to time in thickness or bulk since then variable bulk has to be accommodated in the same size and shaped envelope, in order to obviate the need to use a range of sizes and shapes of envelopes.

Broadly, it is an object of the present invention to provide a transmittal envelope for varying bulk overcoming, by advantageous use of isosoles-shaped outwardly folded gussets, the noted omission as well as other shortcomings of the prior art.

More particularly, it is an object to embody isosoles triangle-shaped gussets in the envelope which effectively grip edges of a document assemblage or equivalent insert positioned in the envelope, to hold the assemblage/insert in place which correspondingly maintains its rectangular shape, its front panel and rear panel in parallel relation with each other, and has other appearance-enhancing attributes, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
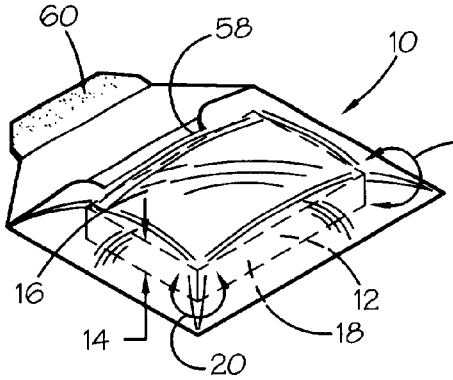
FIG. 1 PRIOR ART
FIG. 1 is a perspective view of a prior art envelope for transmitting an 8½" by 11" stack of documents, or equivalent bulk.

By way of background, reference should be made to FIG. 1 illustrating a cardboard envelope 10 in current popular use for transmitting by mail or messenger or similar delivery, documents 12, typically sized 8½" by 11", stacked upon each other to produce a bulk located in the interior of the envelope 10 as noted at 12. Unavoidably, when the documents 12 are inserted in the envelope 10, the bulk 14 forces the envelope front and rear panels 16, 18 to separate, and this manifests itself as rounded comers 20, i.e. a configurated comer shape which detracts from a neat overall appearance in the envelope 10. In practice, it has been found that the noted unattractive appearance of the prior art envelope 10 detracts from the importance of the contents of the envelope in the minds of the addressee/deliveree.

Figure 2:
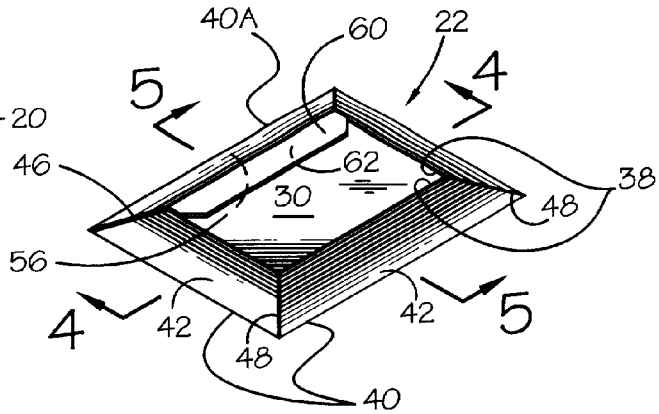
FIG. 2 is a similar perspective view of a transmittal envelope for the same primary end purpose constructed in accordance with the present invention.
Figure 3:
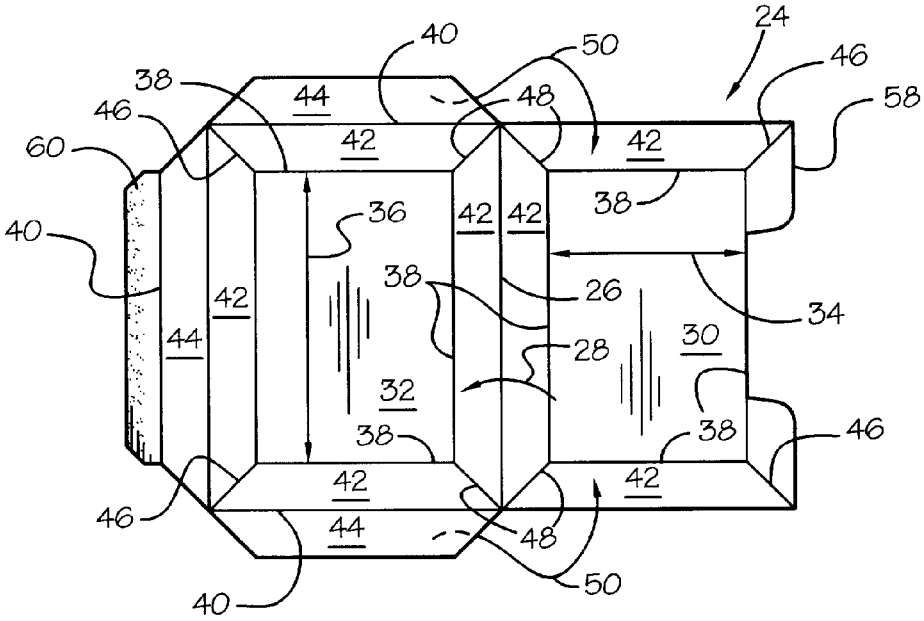
FIG. 3 is a plan view of a flat cardboard blank used in the construction of the three dimensional envelope of FIG. 2.

Overcoming the foregoing and other shortcomings of the prior art is an envelope, generally designated 22, shown in a three-dimensional document-transmitting condition in FIG. 2 assembled from a flat, die-cut blank, generally designated 24 in FIG. 3. Blank 24 of cardboard construction material has a medial fold line 26 about which it is folded in the direction 28 superimposing what is destined to be its front panel 30 over what is destined to be its rear panel 32, both panels 30, 32 having a width dimension 34 and length dimension 36 which are approximately 8½" by 11" respectively. The front and rear panels are delimited by first fold lines, individually and collectively designated 38 having an inboard location in the document-transmitting FIG. 2 condition and by second fold lines, again individually and collectively designated 46 but having in said FIG. 2 condition an outboard location.

Along at least opposite sides and a top of the rear panel 32 the inboard and outboard fold lines 38, 40 bound therebetween one panel of what is destined to serve as a side of an isosceles triangle, the purpose of which isosceles triangle-forming panels, individually and collectively designated 42, will soon be better understood as the description proceeds. On the rear panel 32 cooperating with the triangle-forming panels 42 are second isosceles-forming panels, individually and collectively designated 44, said isosceles-forming panels 42, 44 being interconnected to each other at four comers by angled and thus aptly described miter joint-like folds 48. Similar miter joint like folds 48, but angled in an opposite direction, are provided at the bottom in-board comers of the front panel 30.

To assemble the blank 24 of FIG. 3 into the three-dimensional configuration of FIG. 2 an adhesive coat on the rear surfaces of the rear panel side triangular-forming panels 44 are folded along the fold lines 40 so that contact is made therewith by top and bottom triangular-forming panels 42 of the front panel 30 as depicted by the arrows 50. After the adhesive attachment of the panels 44, 42 as just noted, documentation 52, typically comprised of stacked 8½" by 11" sheets giving rise to a thickness 54 is inserted through an opening 56 bounded by a configurated edge 58 of the front panel 30 and the outboard fold line 40A, after which the opening 56 is closed by a glue flap 60 folded over into contact, as at 62, along the top of the front panel 30.

Figure 4:
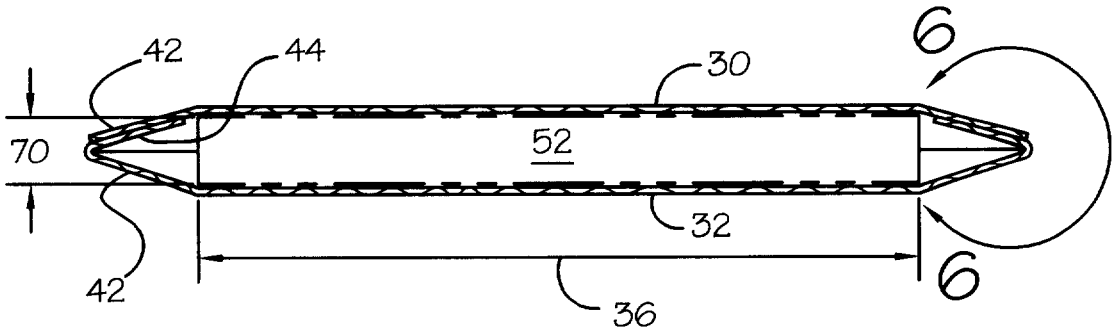
FIG. 4 is a side elevational view of the FIG. 2 envelope as seen along line 4—4 of FIG. 2.
Figure 5:
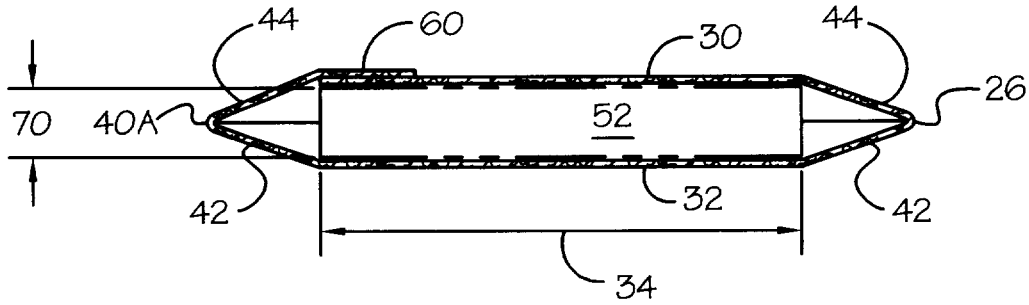
FIG. 5 is a cross sectional view of the envelope as seen along line 5—5 of FIG. 2.
Figure 6:
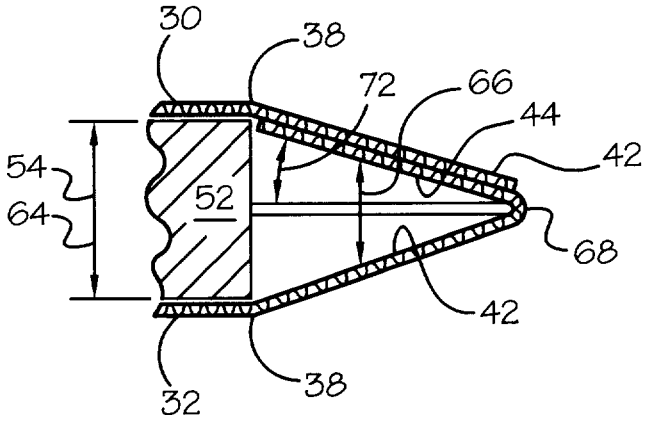
FIG. 6 is a partial cross sectional view, on an enlarged scale, of a side isosceles triangle configuration of the FIG. 2 envelope as circumscribed by arrow 6—6 of FIG. 4.

In the preceding description panels 42 and 44 are referred to as having an isosceles-forming function, but these panels will also be understood to serve the important function of gripping the sides of the transmitted documentation 52 so that said documentation 52 stays flat and in place, i.e. does not shift sidewise, between the front panel 30 and rear panel 32, all as is better understood from FIGS. 4, 5 and 6.

In functional parlance, the isosceles-forming pairs of panels 42 and 44 are documentation-gripping panels, in that as gripping panels, they have a base dimension 64 (see in particular FIG. 6) which is approximately equal to the thickness 54 of the documentation 52 and, most important to note, progressingly outward of the base 64 the distance between the gripping panels 42 and 44 diminishes, so that for example, adjacent the base 64 the distance 66 is less than that of the base 64 and so on in the direction of the triangle apex 68. Thus, the thickness 64 of the documentation 52 on all four sides is oversized in relation to the size of the triangle base 64 and thus cannot move or shift into a position within any of the triangular configurations of FIG. 6, to thereby contribute to a stabilized condition of the documentation 52. Stated somewhat differently, the front and rear panels 30, 32 within the inboard boundary fold lines 36 remaining during mail or delivery transport in a desired neat parallel relation, as noted at 70.

In practice, good results have been achieved handling a documentation or equivalent item of bulk, having a thickness of 1 inch and producing an isosceles triangle, subtending an angle of approximately 19 degrees, as noted at 72.

It is to be understood that it is within the contemplation of the present invention to use the envelope 22 not only for items of bulk in the specific nature of a stack of documents 52, but also for qualifying merchandise in boxes or otherwise packaged which assumes a rectangular shape, preferably 8½ by 11 inches and, most important, has a height or bulk that in the prior art envelope, as exemplified by the envelope 10 of FIG. 1, would cause the comer unsightliness noted in FIG. 1. This unsightliness is obviated for bulk merchandise just as effectively as it is for the assemblage 52 of documents using the transmittal envelope 22.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An envelope of cardboard construction material of a type used to transmit stacked documentation having a three-dimensional rectangular shape of a selected width, length and thickness, said envelope comprising facing front and rear panels of rectangular shapes each delimited by at least opposite side edges and a bottom edge of a selected width and length adapted to match said width and length of said transmitted documentation, at least three pairs of cooperating two panels each two panels being joined along a central fold line to each other and presenting opposite connecting edges, fold lines for integrally connecting said connecting edges of said three two-panel pairs to confronting opposite side and bottom edges of said front and rear panels so that separation of said front and rear panels from each other is adapted to cause an unfolding of each said pair of two panels into a shape of an isosceles triangle oriented outwardly of said fold line-attached opposite edges and bottom edge of said front and rear panels, and an operative condition of said documentation inserted in said envelope in an interposed position between said front and rear panels so as to cause said front and rear panels to separate from each other and said three pairs of two panels to unfold into said isosceles triangles, whereby a dimensional size adjacent a base of each said triangle is of an extent less than that of said thickness of said inserted documentation to obviate any shifting movement of said inserted documentation from between said front and rear panels to thereby contribute to maintaining a parallel appearance of said front and rear panels during use of said envelope.

2. An envelope of cardboard construction material of a type used to transmit an object having a three-dimensional rectangular shape of a selected width, length and thickness, said envelope comprising facing front and rear panels of rectangular shapes each delimited by at least opposite side edges and a bottom edge of a selected width and length adapted to match said width and length of said transmitted object, at least three pairs of cooperating two panels each two panels being joined along a central fold line to each other and presenting opposite connecting edges, fold lines for integrally connecting said connecting edges of said three two-panel pairs to confronting opposite side and bottom edges of said front and rear panels so that separation of said front and rear panels from each other is adapted to cause an unfolding of each said pair of two panels into a shape of an isosceles triangle oriented outwardly of said fold line-attached opposite edges and bottom edge of said front and rear panels, and an operative condition of said object inserted in said envelope in an interposed position between said front and rear panels so as to cause said front and rear panels to separate from each other and said three pairs of two panels to unfold into said isosceles triangles, whereby a bulk size of said object adjacent a base of each said triangle is of an extent greater than that of said triangle base of said inserted object to obviate any shifting movement of said inserted object from between said front and rear panels to thereby contribute to maintaining a parallel appearance of said front and rear panels during use of said envelope.

* * * * *